US007228625B1

(12) United States Patent
Zerebilov

(10) Patent No.: US 7,228,625 B1
(45) Date of Patent: Jun. 12, 2007

(54) METHOD FOR ATTACHING AN ELECTRICAL CABLE TO A CONNECTOR SHIELD

(75) Inventor: Arkady Y. Zerebilov, Lancaster, PA (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/484,774

(22) Filed: Jul. 12, 2006

(51) Int. Cl.
*H01R 43/04* (2006.01)

(52) U.S. Cl. ..... 29/861; 29/825; 29/828; 29/854; 29/857; 29/865; 29/866; 29/868; 174/34; 174/36; 174/71 C; 174/72 A

(58) Field of Classification Search ..... 29/861, 29/825, 828, 854, 857, 865, 866, 868; 174/34, 174/36, 71 C, 72 A
See application file for complete search history.

(56) References Cited

U.S. PATENT DOCUMENTS 4,010,538 A 3/1977 O'Keefe et al.
5,055,063 A 10/1991 Sato
5,295,868 A * 3/1994 Viaud et al. ..... 439/610
5,716,236 A 2/1998 O'Sullivan et al.
6,143,986 A * 11/2000 Anderson et al. ..... 174/72 A
7,070,440 B1 7/2006 Zerebilov et al.

* cited by examiner

*Primary Examiner*—A. Dexter Tugbang
*Assistant Examiner*—Tim Phan
(74) *Attorney, Agent, or Firm*—Daniel R. Edelbrock

(57) ABSTRACT

An intermediate portion of the outer insulation of a shielded electrical cable is removed near an end of the cable. A remaining small segment of the outer insulation at the cable end is moved axially inward along the cable to bunch up an exposed conductive braid of the cable. The bunched up braid is pinched to form a flattened, bell-shaped element on two opposite sides of inner conductive wires of the cable. The inner wires are attached to electrical terminals and the terminals are inserted into an insulator mounted within a conductive connector shield. The flattened elements are simultaneously aligned between opposite crimp arms extending from sides of the connector shield. The arms are crimped onto the flattened elements using an ultrasonic/vibration type crimping process or a shear lock crimping process. Since the flattened braid elements extend away from the cable, the crimping process is offset from the inner wires.

15 Claims, 8 Drawing Sheets

METHOD FOR ATTACHING AN ELECTRICAL CABLE TO A CONNECTOR SHIELD

BACKGROUND OF THE INVENTION

1. Field of the Invention

This invention relates in general to terminating shielded electrical cables in electrical connectors, and more specifically to a combination of a cable preparation method, a connector shield structure and a crimping process for attaching a conductive braid of the cable to the connector shield.

2. Discussion of Related Art

There are some common methods of crimping the conductive braid or sheath of a coaxial electrical cable to a connector shield. In one method, crimped tabs formed with a connector shield body have sharp edges that penetrate a surrounding, insulative jacket of the cable to contact the conductive braid when the tabs are crimped around the cable. This is a fast method but produces a crimped interface with a weak retention force. A number of environments, particularly automotive, require a high retention force.

Another conventional method is characterized by a dual tubular structure. One tube, a ferrule, is a separate component and sandwiches the braid between the ferrule and a tubular part of the connector shield. Crimping the ferrule around the braid and tubular part of the shield provides a higher retention force, but requires handling of the loose ferrule and manual cable preparation to separate and terminate the braid. This method is also difficult and expensive to automate, so it is usually manually performed. Therefore, neither of these described methods is ideal for low-cost, mass-produced terminations of shielded cables for automotive environments.

A twisted pair shielded electrical cable also requires a better approach for termination to a connector shield. This cable has multiple wires comprising a non-circular inner core and wrapped by a shielding foil and braid. A traditional crimping method as described can create a reliable, high strength crimp interface, but the braid termination is time consuming and very hard to automate. The non-circular inner core requires protection from damage during the high force crimping process. This usually necessitates providing an internal, rigid tube between the braid and inner core, increasing the component count as well as putting another step in the assembly process.

SUMMARY OF THE INVENTION

Accordingly, it is an object of this invention to provide a cable preparation method, a connector shield structure, and a crimping process that enables a conductive shield of the cable to be reliably attached to the connector shield without additional components.

Another object of the invention is to offset the crimping forces from the inner conductive wire or wires of the cable so the inner wire or wires are not damaged during the crimping process.

A further object of the invention is to enable easier automation of the crimping process for a shielded cable.

In carrying out this invention in the illustrative embodiment thereof, a portion of an outer insulation of a twisted pair shielded cable is removed. An exposed conductive sheath or braid of the cable is bunched up and then pinched or compressed into a substantially flat, bell-shaped element or configuration on opposite sides or regions of the cable. The wires in an inner core of the cable are secured to electrical terminals. The flat or flattened elements are aligned between sets of opposed crimp arms extending from a connector shield when the terminals are inserted into the shield. The arms are then crimped around the elements in an ultrasonic or shear lock crimping process.

This method enables cost-effective, semi-automation or full automation of a crimping process for securing a conductive braid to a connector shield body. Though intended to solve problems in the termination of twisted pair shielded cables, the method is readily applicable to a radio frequency cable or other types of shielded cable. The method provides excellent retention strength to prevent the crimp interface from opening up when the cable is subjected to high tensile forces encountered within the automotive environment. By moving the crimping forces to the sides of the cable, the inner core of the cable is protected from damage.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
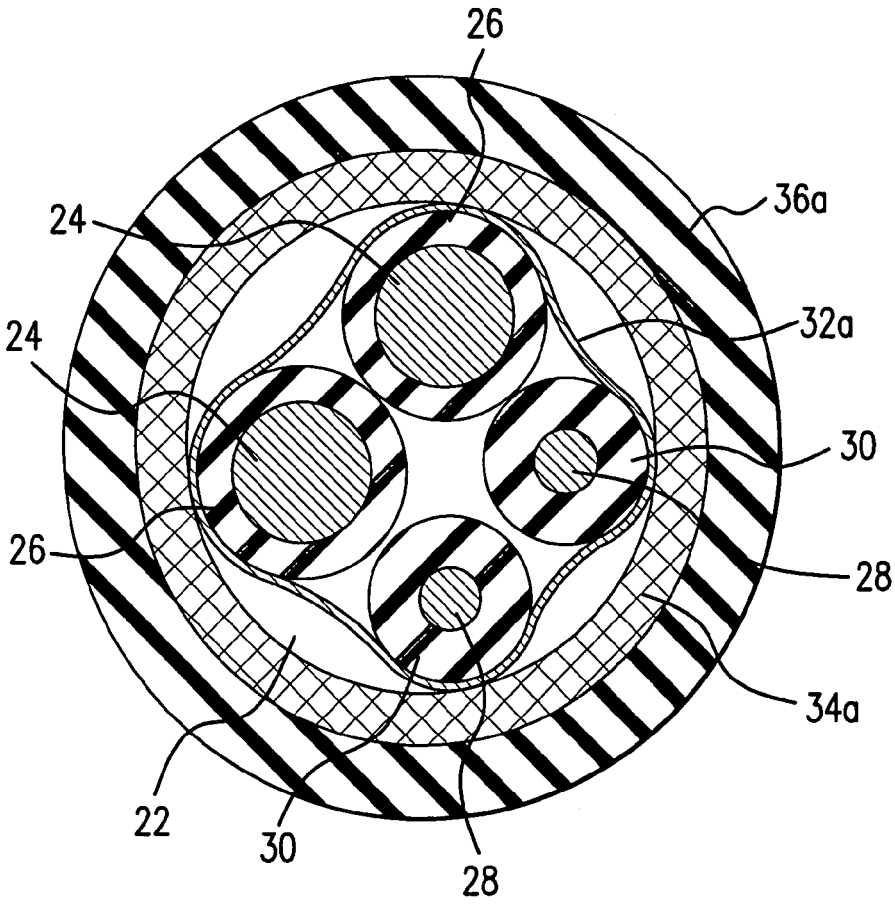
FIG. 1 is an enlarged representation of a twisted pair shielded cable construction.

Referring now to FIG. 1, the construction of a twisted pair shielded cable as used with the present invention is broadly represented in an enlarged end view. In an inner core 22, there are four inner conductive wires. The cable has two power wires 24 each covered by an insulation layer or jacket 26. There is also a twisted pair of signal wires 28 each covered by their own insulation layer or jacket 30. The insulation layers are made from an electrically insulative material such as Polyvinyl Chloride (PVC).

The inner conductive wires are collectively wrapped in a layer of foil 32*a*, such as aluminum, forming a first part of a shielding component of the cable. A second part of the shielding component of the cable comprises an electrically conductive sheath or braid 34*a*, made of copper for example, wrapped around the inner core 22 and the foil 32*a*. An outer insulation layer or jacket 36*a* of PVC or other electrically insulative material surrounds the conductive braid 34*a*. The present invention provides a method and structure for terminating this twisted pair shielded cable in a connector shield. However, the invention may be used with other types of shielded cable such as coaxial or radio frequency cable.

Figure 2:
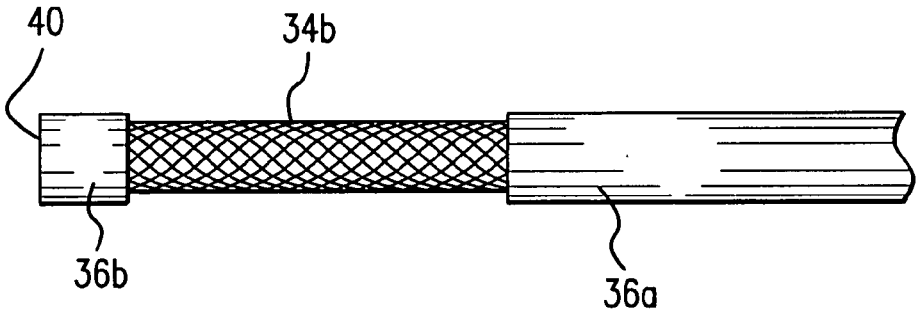
FIG. 2 depicts the first step in a cable preparation process, particularly the removal of a portion of outer insulation.

FIG. 2 illustrates the first step in preparing the shielded cable for termination in an electrical connector shield. Adjacent an end 40 of the cable, an intermediate portion of the outer insulation layer 36*a* is stripped or removed from the cable. This exposes a section 34*b* of the conductive braid 34*a* and leaves a relatively small end segment 36*b* of outer insulation around the braid at the cable end 40. The insulation end segment 36*b* is spaced from a main or remaining portion of the outer insulation layer 36*a* by the length of the exposed section 34*b* of the conductive braid 34*a*.

Figure 3:
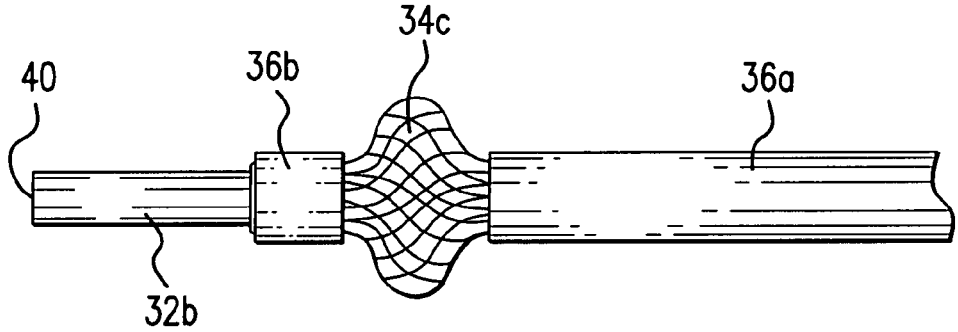
FIG. 3 illustrates a second step of bunching up a conductive braid of the cable.
Figure 4:
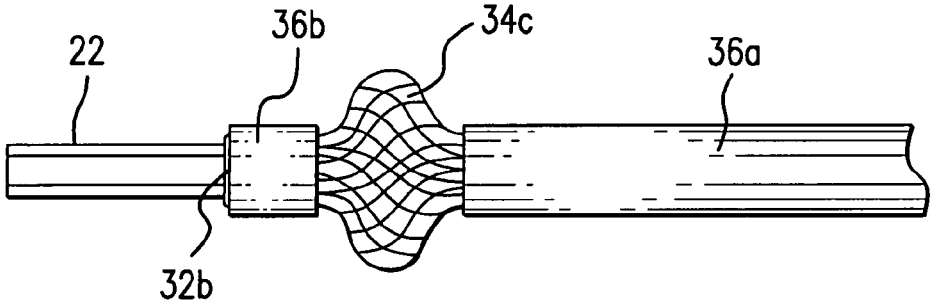
FIG. 4 shows the result of stripping a surrounding foil of an inner core of the cable to expose inner power and signal wires.
Figure 5:
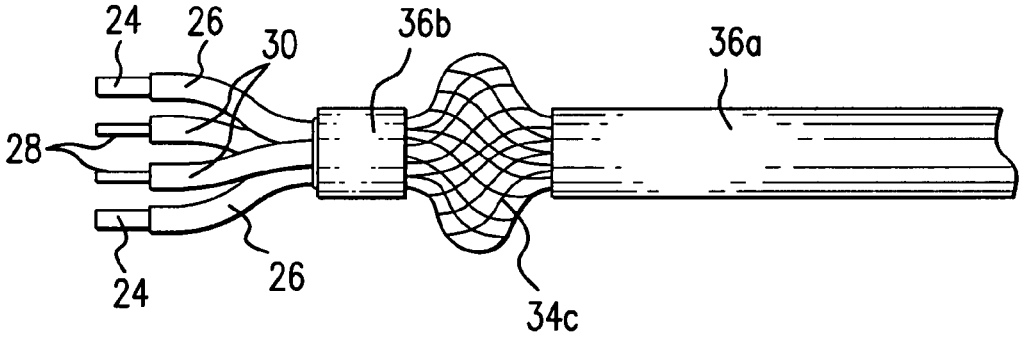
FIG. 5 illustrates the inner core wires in a stripped condition for termination to electrical terminals.

Next, as depicted in FIG. 3, the exposed section 34*b* of the braid 34*a* is gathered or bunched up into a semi-spherical section 34*c* by sliding or moving the insulation end segment 36*b* axially inward along the cable from cable end 40. This exposes an end section 32*b* of the shielding foil 32*a* at the end 40 of the cable. The end section 32*b* of the foil 32*a* is then removed or stripped from the inner conductive core 22 or wires (FIG. 4). As shown in FIG. 5, the wires 24 and 28 are then spread apart and short lengths of the individual insulation layers 26 and 30, respectfully, are removed or stripped back from ends of the wires.

Figure 6:
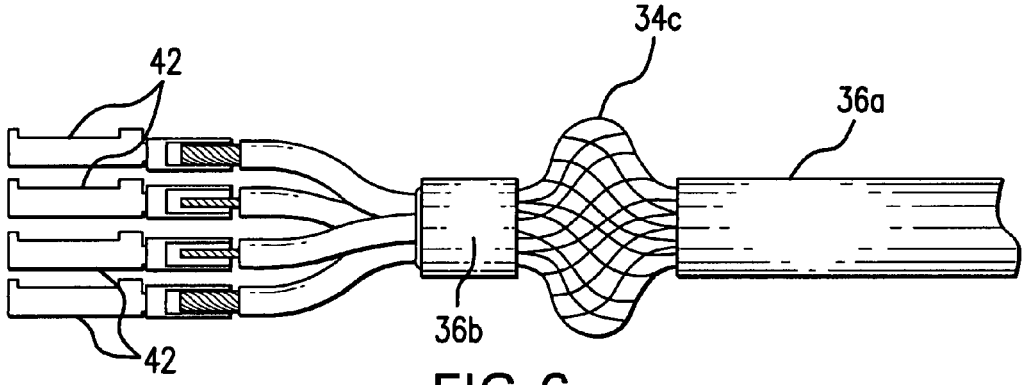
FIG. 6 depicts a step of attaching electrical terminals on ends of the wires.
Figure 7:
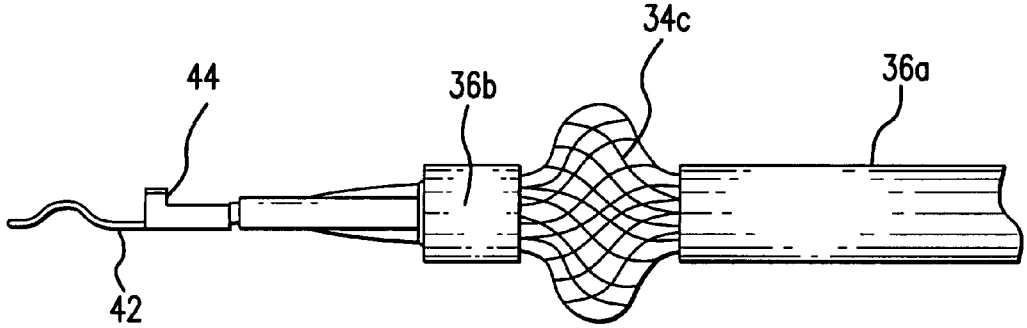
FIG. 7 is a side view with the wires attached to the terminals.

In the following step, as represented in FIGS. 6 and 7, electrical terminals 42 are crimped, soldered or otherwise attached to the stripped ends of the wires 24 and 28. The electrical terminals could be male or female terminals depending on the environment and the type of connector shield to be used. The male and female terminals could also be of various types and structure. The terminals 42 each include a retention shoulder 44. In the FIG. 7 side view the terminals are shown as being aligned in a row or common plane with the braid section 34*c* still in a bunched up configuration.

Figure 8:
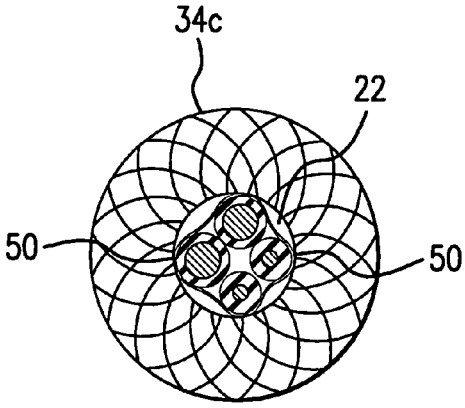
FIG. 8 is an end, cross-sectional view of the cable showing the surrounding, bunched up braid.
Figure 9:
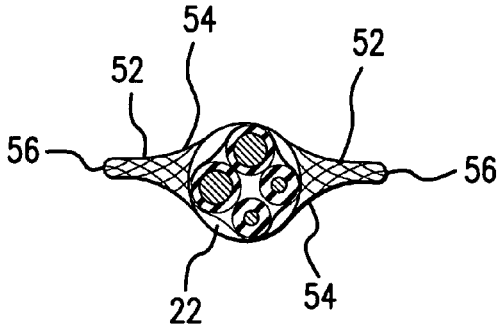
FIG. 9 is an end, cross-sectional view of the cable showing the surrounding braid in a forcibly compressed or pinched configuration.
Figure 10:
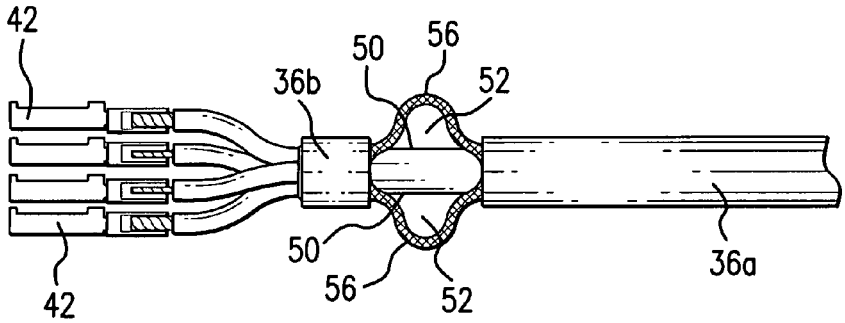
FIG. 10 shows a top view of the pinched braid.

FIGS. 8–10 are meant to illustrate the next step in the cable preparation process. On opposite sides or opposite facing surfaces 50 of the inner conductive core 22 of the cable, the bunched up braid 34*c* as configured in FIG. 8 is compressed or pinched into substantially flattened elements 52 extending away from the cable and shaped as depicted in FIG. 9. The braid pinching is done in-line with the terminals so, as best shown in FIG. 10, the flattened elements 52 lie in the same plane as, or in a plane closely parallel to, the aligned terminals 42. The bunched up braid 34*c* is pinched either by hand or by a spreading-clamping set of opposed grippers. In other words, the flattened elements 52 of the braid end up looking like bell-shaped curves on either side or opposite peripheral region of the cable parallel to the terminal row. The flattened elements 52 have a slightly wider cross-section 54 where the braid surrounds the foil 32*a* and inner core 22 of the cable and narrow to their outer perimeters 56. The pinching step creates air voids within the flattened elements. This pinching step may also be performed before the wires 24 and 28 are prepared for termination or terminated.

Figure 11:
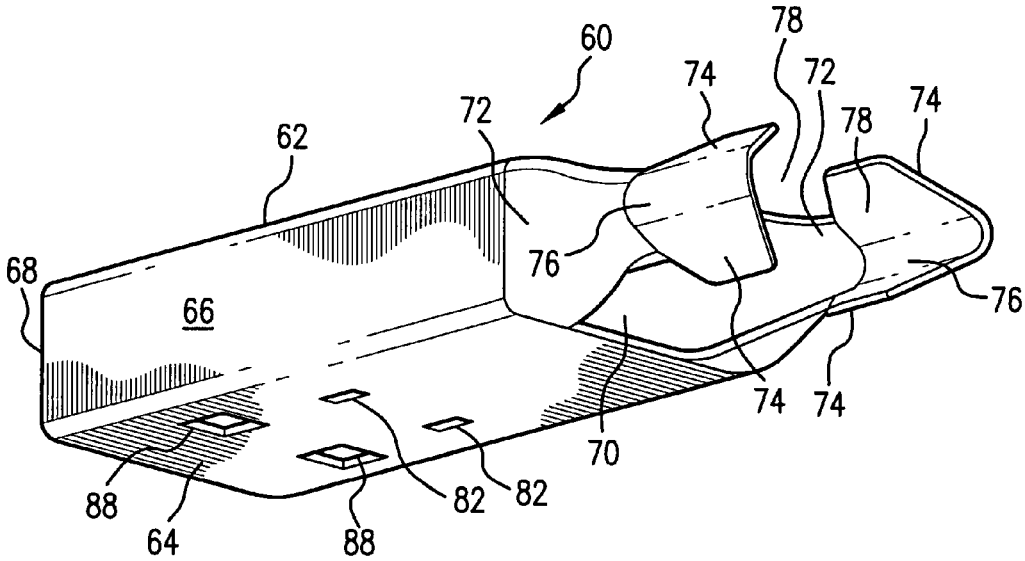
FIG. 11 is an isometric view of a connector shield according to the present invention, looking from a cable attachment end and slightly under the shield.
Figure 12:
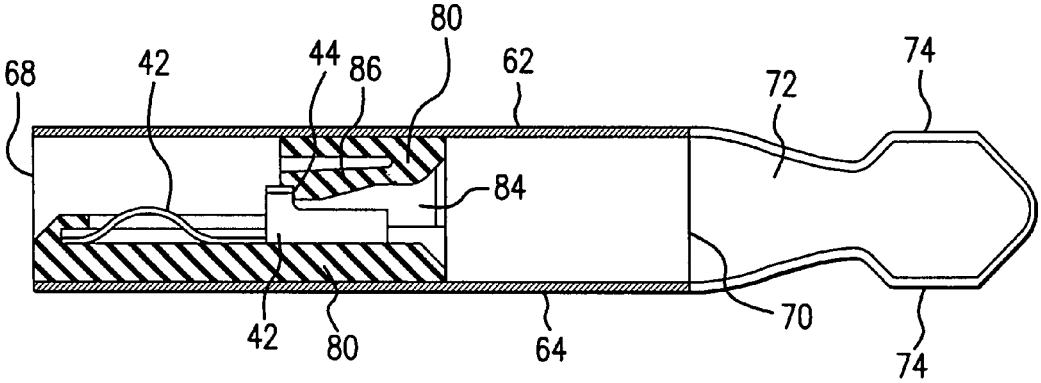
FIG. 12 is a cross-sectional view of the connector shield to illustrate an inner insulator for gripping the terminals.

The prepared, terminated cable end is now ready for insertion into and electrical connection with an electrical connector shield. FIGS. 11 and 12 show a connector or connector shield 60 according to the present invention. The shield 60 is made of an electrically conductive material such as brass or stainless steel. As oriented in the drawings, it has a body or housing with an upper side 62, an underside 64, two parallel opposite sides 66, a connector mating end 68 and a terminal insertion end 70. The connector mating end 68, with the terminals 42 illustrated by example, would provide a Universal Serial Bus (USB) interface. An elongated member 72 extends from each side 66 at the terminal insertion end 70. The members 72 are substantially parallel to each other, extending along a longitudinal axis of the connector shield 60 and facing each other across the axis. The members 72 partially surround an area at the terminal insertion end 70 of the shield 60. Each member 72 has two crimp arms 74 formed on an end 76 of the member distal from the shield. Each set of arms 74 create a u-shaped or v-shaped crimp tab at a set or predetermined length or distance from insertion end 70. The arms 74 form openings 78. The openings 78 are in the same general plane, face each other, and are spaced apart by a distance approximately equal to or slightly greater than a width of the cable.

The connector shield 60 receives the terminals 42 through the terminal insertion end 70. FIG. 12 illustrates how the terminals 42 are held in the shield. The wires 24 and 28 are not shown for reasons of clarity. An insulator 80 made of an electrically insulative material such as Nylon, or any of a variety of extruded plastics, is fitted within the shield 60 and retained or held by protrusions (not shown) extending into indentations 82 in the shield. This retention structure is only an example. The insulator 80 may be held within the shield 60 by adhesive, fasteners, interference or force fit, or other conventional means. The insulator 80 includes terminal accommodating chambers 84 and a row of deflectable lances 86 for snapping behind the retention shoulders 44 of the terminals 42 to secure the terminals in the insulator and shield. The terminal accommodating chambers 84 are in a plane adjacent to and substantially parallel with the planes of the members 72 and crimp arms 74, providing an approximately straight cable end insertion line. The connector shield 60 could include windows 88 on the upper side 62 and the underside 64. If the connector shield 60 is used as a USB interface the windows 88 would provide a lock feature for a mating connector. The windows could also be used for confirming the positions of the terminals 42 and insulator 80 within the shield 60.

Figure 13:
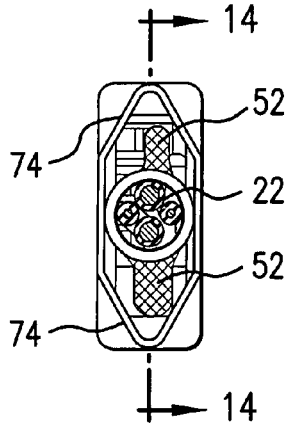
FIG. 13 is an end view of the cable and connector shield taken from a rear of the connector shield.
Figure 14:
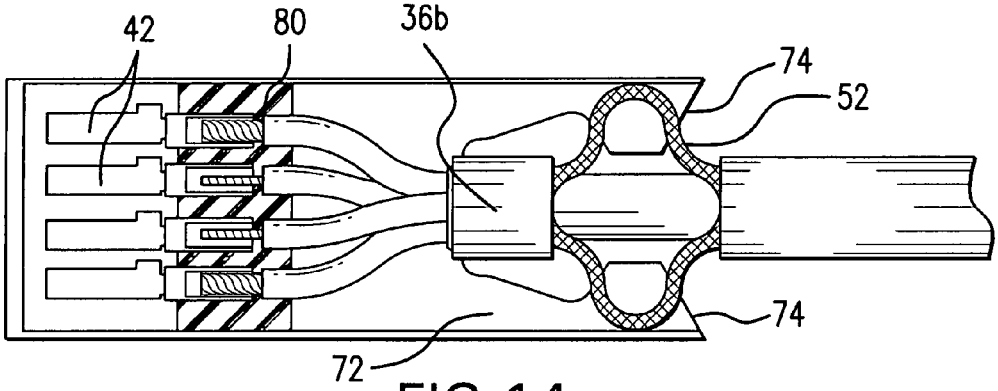
FIG. 14 is a cross-sectional top view of the connector shield and inserted cable and terminals taken on section line 14—14 of FIG. 13.
Figure 15:
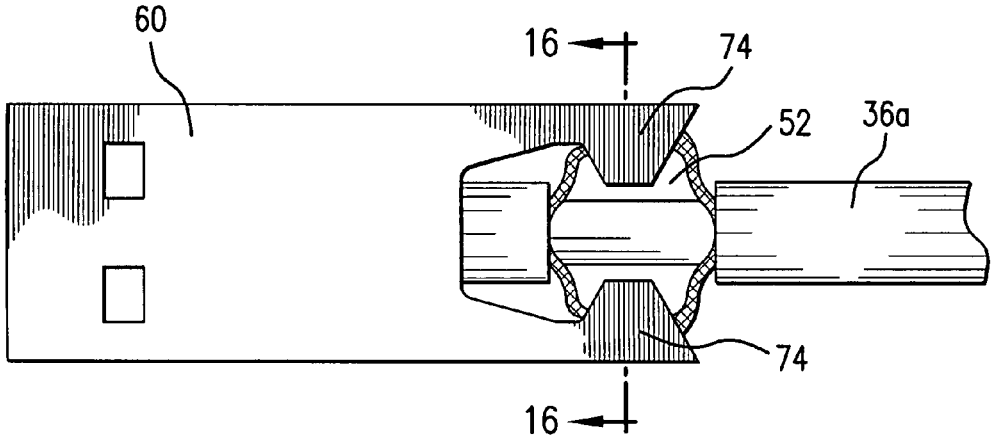
FIG. 15 is a top view of the connector shield and cable secured together.
Figure 16:
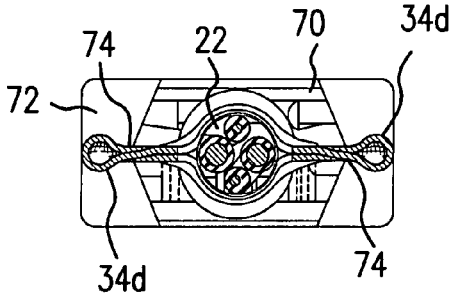
FIG. 16 is a cross-sectional end view of the cable and connector shield taken on line 16—16 of FIG. 15 and enlarged for clarity.
Figure 17:
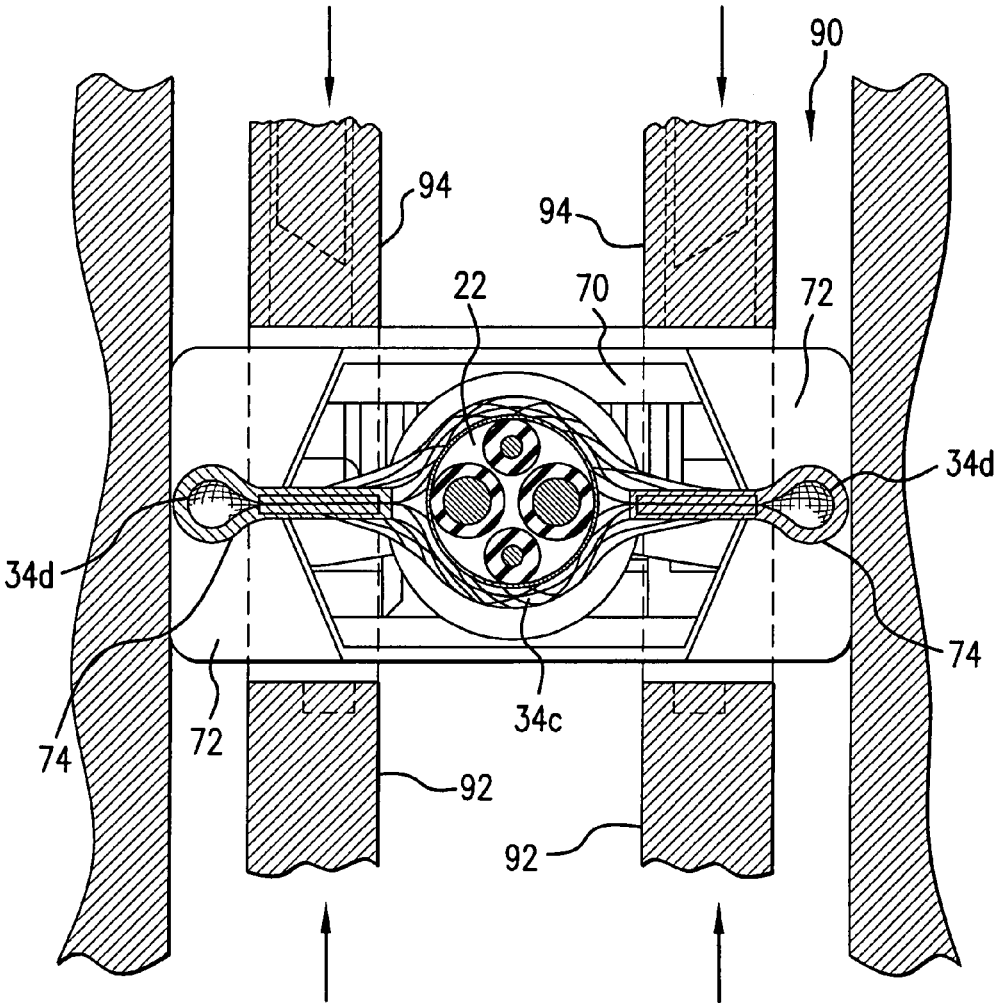
FIG. 17 is an enlarged cross-sectional view of the cable, connector shield, and a crimping applicator used to secure the cable and connector shield together.

The terminated cable end is aligned with the ends 76 of the members 72 and pushed or fed between the members such that the terminals 42 enter the terminal accommodation chambers 84 through the insertion end 70 of the connector shield 60 as a flattened element 52 on each side 50 of the cable aligns between a set of crimp arms 74. The lances 86 in the insulator 80 snap or move behind the terminal shoulders 44 to secure the terminals 42 in the insulator and shield 60. Simultaneously, the bell-shaped curves of the flattened elements 52 line up between each set of crimp arms 74, as demonstrated in FIGS. 13 and 14. A crimping tool or crimp applicator is then used to crimp the arms 74 to sandwich and secure the flattened elements 52 between them. The crimped connector shield is depicted in FIGS. 15 and 16. The arms have been crimped around the flattened elements 52 using an ultrasonic/vibration process. FIG. 17 illustrates a crimping applicator 90 specifically designed for crimping the arms 74 of the connector shield 60 around each flattened element 52. The bottom bars 92 provide a support action while the upper bars 94 perform the crimping action. The crimped braid 34*d* is clamped in the arms.

Figure 18:
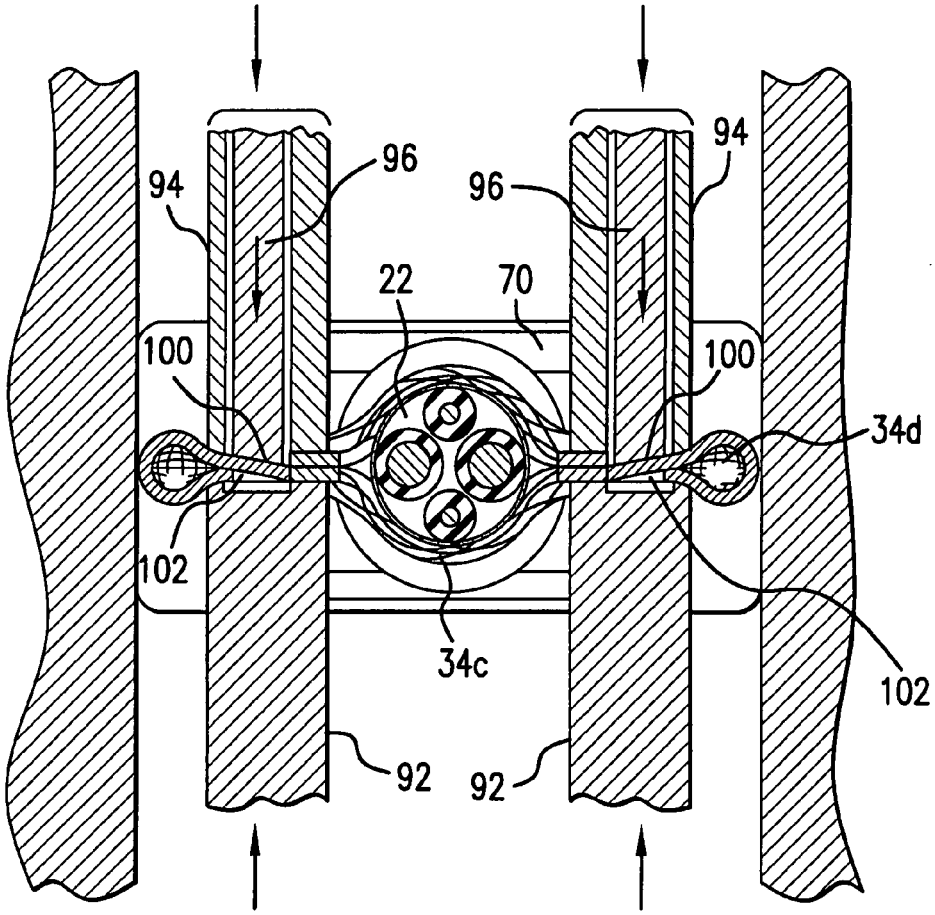
FIG. 18 is an enlarged cross-sectional view of the crimping applicator when used to secure the cable and shield together by a shear lock process.
Figure 19:
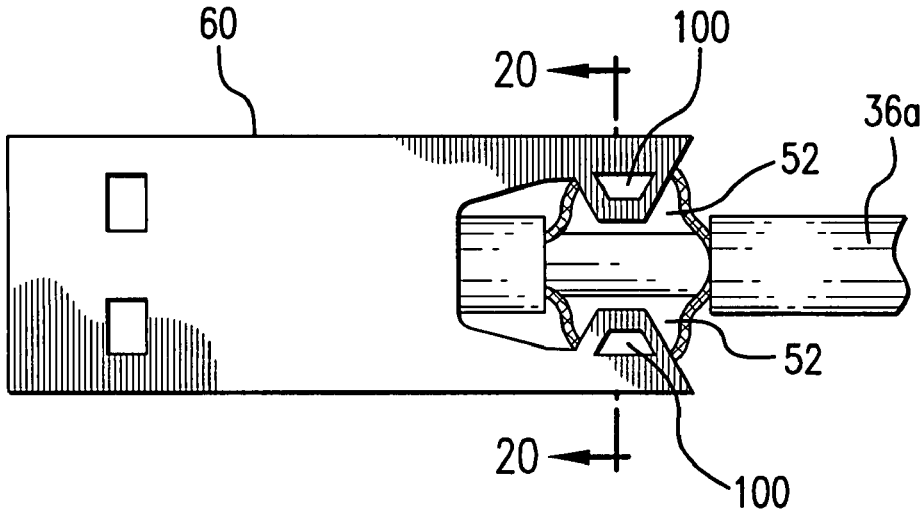
FIG. 19 is a top view of the connector shield and cable secured together by the shear lock process of the crimping applicator.
Figure 20:
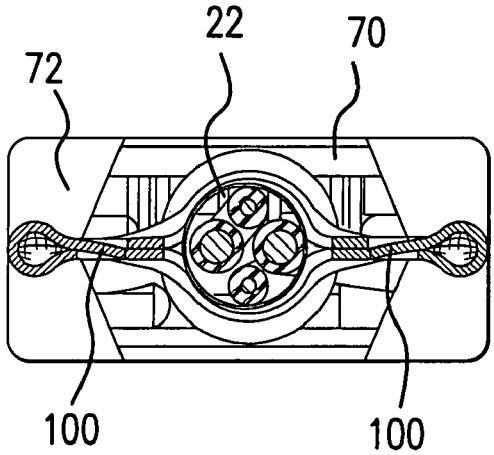
FIG. 20 is a cross-sectional end view of the cable and connector shield secured together by the shear lock process, taken on line 20—20 of FIG. 19 and enlarged for clarity.

This crimping applicator 90 can perform the ultrasonic crimping process during a bottoming stroke of the crimping tool, or can perform a shear lock crimping process as illustrated in FIG. 18, depending on specific crimp retention requirements. In the shear lock crimping process, inner blades 96 in the upper bars 94 cut through one of the arms 74 of each set to form a shear lock component 100, and bend the shear lock component 100 into an aperture 102 formed in the opposite arm. The shear lock components 100 could alternatively be stamped or pre-cut into one of the arms 74 of each set. The crimping process would then be arranged to simply force the pre-cut shear lock components 100 into the apertures 102 in the opposite arms. The results of the shear lock crimping process are illustrated in FIGS. 19 and 20.

The crimping applicator secures the terminated cable end to the connector shield 60 and establishes reliable electrical contact between the conductive braid 34*a* and the shield. The crimp interface is offset to the sides of the inner core 22 of the cable, so the core is not damaged by the crimp tool 90 and needs no additional protection. The process can be automated. After the crimping process, an outer connector housing of electrically-insulative material can be over-molded on the connector shield 60 and cable end to provide strain relief for the cable.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A method of attaching an electrical cable to a connector shield, the cable having an end and a conductive braid between an outer insulation layer and at least one inner conductive wire, the method comprising the steps of:

removing an intermediate portion of the outer insulation layer between an end segment of the outer insulation layer adjacent the cable end and a main portion of the outer insulation layer to expose a section of the conductive braid;

bunching up the braid section by moving the end segment of the outer insulation layer toward the main portion;

compressing the bunched up braid to produce two substantially flattened elements protruding from opposite sides of the cable;

aligning each element inside the connector shield between opposed arms of the connector shield; and securing the arms around the elements.

2. The method of claim 1 wherein the step of compressing the bunched up braid section is performed by hand to produce two bell-shaped curves on opposite sides of the cable.

3. The method of claim 1 wherein the step of compressing the bunched up braid section is performed by using a gripping tool to spread and clamp the braid and produce two bell-shaped curves on opposite sides of the cable.

4. The method of claim 1 wherein the cable includes a shielding layer of foil between the braid and the at least one inner conductive wire, and the method includes the step of stripping the foil to expose the at least one inner conductive wire at the cable end after the braid section is bunched up.

5. The method of claim 4 wherein the at least one inner conductive wire has individual insulation, and this individual insulation is stripped off the at least one exposed inner conductive wire after the foil is stripped.

6. The method of claim 5 further comprising the step of fastening an electrical terminal to the at least one exposed, stripped inner conductive wire.

7. The method of claim 6 wherein the fastening step comprises crimping the terminal on the at least one exposed, stripped inner conductive wire.

8. The method of claim 7 wherein the step of aligning each flattened element inside the connector shield includes inserting the electrical terminal into a terminal accommodating chamber within the connector shield.

9. The method of claim 8 wherein there are multiple inner conductive wires and an electrical terminal is crimped on each inner conductive wire, and wherein the terminals are positioned in a row for insertion into the connector shield, the row being in a plane parallel to a plane of the flattened elements.

10. The method of claim 1 wherein the arms are secured around the flattened elements using a crimping process.

11. The method of claim 10 wherein the step of crimping the arms around the elements includes placing the connector shield into a crimping applicator.

12. The method of claim 11 wherein the arms are ultrasonically joined during a crimping stroke of the crimping applicator.

13. The method of claim 11 wherein the arms are shear-locked to the elements during a crimping stroke of the crimp applicator.

14. The method of claim 10 wherein the opposed crimp arms of the connector shield are v-shaped with openings in the same general plane facing each other across a distance approximately equal to a width of the cable, such that the step of securing the arms around the flattened elements is done by a single stroke of a crimping applicator offset from the cable.

15. The method of claim 14 wherein the opposed crimp arms of the connector shield are on ends of members extending parallel to each other from opposite sides of the connector shield to a set length, such that the step of aligning each flattened element inside the connector shield between the opposed arms properly positions the end of the cable in the shield.

* * * * *